US008348790B2

(12) United States Patent
York

(10) Patent No.: US 8,348,790 B2
(45) Date of Patent: Jan. 8, 2013

(54) SHUTTLECOCK-TYPE GAME BALL AND METHOD OF MANUFACTURING SAME

(76) Inventor: Keith Ray York, Elk Grove, CA (US)

( * ) Notice: Subject to any disclaimer, the term of this patent is extended or adjusted under 35 U.S.C. 154(b) by 637 days.

(21) Appl. No.: 12/384,225

(22) Filed: Apr. 2, 2009

(65) Prior Publication Data

US 2010/0255939 A1 Oct. 7, 2010

(51) Int. Cl.
*A63B 67/18* (2006.01)

(52) U.S. Cl. ..... 473/579

(58) Field of Classification Search ..... 473/579, 473/580

See application file for complete search history.

(56) References Cited

U.S. PATENT DOCUMENTS 227,884 A * 5/1880 Duchemin ..... 473/474
1,393,407 A * 10/1921 Tenney ..... 473/580
2,666,643 A * 1/1954 Miller ..... 473/580
2,860,879 A * 11/1958 Carlton ..... 473/579
3,560,128 A * 2/1971 Carlton ..... 473/579
4,519,613 A * 5/1985 Martin ..... 473/579
4,538,818 A * 9/1985 Sinclair ..... 473/579
4,776,596 A * 10/1988 Nojima ..... 473/281

* cited by examiner

*Primary Examiner* — John Ricci
(74) *Attorney, Agent, or Firm* — DLC Patents, PLLC; Dustin L. Call

(57) ABSTRACT

A training device including a spherical body made of any combination of foam, rubber, cork, twine, leather or any known material used in the construction of a baseball or game play ball affixed to a flight control apparatus by a coupling means. Said ball consisting of a second element including a skirt or flight apparatus resembling a shuttlecock designed for movement, distance and speed control. Said ball consisting of a third element including an inset coupling means. The device being used to fine tune and exercise the muscular-skeletal mechanics related to field sports. The device may be used as a practice and drill specific device or as a child's toy much like a badminton shuttlecock to be thrown, caught or hit.

7 Claims, 7 Drawing Sheets

SHUTTLECOCK-TYPE GAME BALL AND METHOD OF MANUFACTURING SAME

I claim priority to my provisional application Ser. No. 61/072,762 filed on Apr. 1, 2008.

BACKGROUND OF THE INVENTION

Many believe that baseball is the ultimate combination of skill, timing, athleticism, and strategy. The present invention relates to a play device comprising a ball of similar size and shape as that of a baseball, but connected to a shuttlecock apparatus by a locking coupler means. It combines the game of baseball and the game of badminton in a more resilient and customizable way via the locking coupler. Such method of manufacture allows for a variety of shapes or sizes of shuttlecock to be affixed to a standard round ball, thus allowing for greater control of speed and the ability adapt the flight distance of the game ball to allow for play on a smaller field or indoors.

It is well known that feathers mated to a hollow rubber ball—as described in U.S. Pat. No. 1,011,856—serve the purpose of retarding the speed and distance for which the subject ball travels. It is further understood that an embodiment of this design can be used for game play and more specifically, to the game of badminton wherein a shuttlecock is used as the game ball. By establishing limiting parameters on speed and distance similar to that accomplished by a shuttlecock, the invention functions as a trainer baseball for novice players. By creating a means of reducing distance of travel, it opens up more possibilities to play baseball year-round, such as where a traditional field is unavailable or if when raining, to move the game indoors.

As described in U.S. Pat. No. 2,613,935—it is appreciated that a shuttlecock game ball design can be manufactured through the use of a rubber band affixed to the shuttlecock head, said band being substantially equal to the length of the neck portion such that the entire adjoining part of the quill is pressed against the neck portion of the game ball. This design, while functional, would allow that game ball to separate from the quills quite easily during vigorous play such as through contact with a bat or racquet swung with power rather than finesse. Likewise, the use of a glue or other adherent does strengthen the bond between the ball and the shuttle/feathers, but the durability of such glued-on designs does not stand up to the demands of vigorous play such as when a baseball bat is swung at full force towards a fast approaching target.

This invention is ideally-suited for young boys and girls who have yet to develop the much needed elements of athleticism, such as balance and stable footwork. Affixing a larger shuttle to the ball via the interlocking coupler is recommended for those just starting to learn the capabilities of their own bodies. The invention is meant to ease the learning process for the game of baseball by helping children discover their natural abilities of throwing, catching and hitting in a more intuitive way. This is accomplished by the unique combination of slower pace and visual path of flight. Finally, this invention encourages cooperative play with friends and parents in a manner that is safe indoors or outside, where core baseball skills are learned without the need for precise coaching or instruction.

DETAILED DESCRIPTION OF THE INVENTION

By utilizing the design of a shuttlecock connected to a baseball using a locking coupler the game is no longer over when the ability of the player is beyond that of the toy. In this embodiment, the game ball can be transformed to include a shuttlecock of varying size and shape depending on the skill level of the participant. The size and shape of the shuttlecock is inversely correlated to the speed, distance and trajectory of the balls' flight. In other words, affixing a smaller conical flight serves to reduce/control the amount of overall wind drag, creating greater speed and travel distance when hit or thrown.

FIG. 2 illustrates a throwing and catching apparatus. The apparatus includes a generally spherical body. The apparatus also includes a conically shaped apparatus. The conically shaped apparatus include a flanged tip axially oriented toward the center of the spherical body. The apparatus also includes a locking coupler. The locking coupler includes an opposing snapping device or locking means. The conically shaped apparatus is connected to the spherical body by the locking coupler.

An additional advantage of the training baseball, aside from the conical flight/speed control mechanism, is the visual stimulation it provides (FIG. 7). The general direction of the ball is communicated instantly, enabling the child to track the obvious path of travel. The conical apparatus acts as an arrow that points where the ball is heading during the entire flight of the ball. As evidenced in the play of the most skilled professional athletes, errors in judgment are common as the mind is unable to perfectly process the precise landing of the ball in travel. The combination of reduced maximum speed and the ability to visualize the direction the ball is moving at all stages of the flight path allows the brain to anticipate with more swiftness, easing the difficulty of the task of catching the ball. Catching a baseball is a core element of the rules of baseball as doing so before the ball lands on the ground constitutes what is commonly referred to as a "fly-ball" out.

In the case of a ball that lands on the ground before being caught in the field of play, the sport of baseball requires the player to transfer the ball to the appropriate teammate stationed at one of the bases where he/she is guarding against the opposing base runner and making "put-out" before the runner arrives. The trainer baseball facilitates improved growth by helping develop the skill of accurate throwing/pitching by allowing its user to visually self-correct their throwing mechanic relative to the inaccuracy of their previous attempts. In addition to catching and pitching/throwing, the visual-tracking that results with repetitive play with the trainer baseball results in better bat/ball contact, arguably the most integral skill of all in the sport.

As players age and move on from the tee-ball fields to more competitive youth baseball leagues such as Babe Ruth and Cal Ripken, pitch velocity invariably increases. The key to keeping up with pitch speed and having success batting is to develop the fundamental concept of seeing the ball. The earlier one can begin to learn, the better. Seeing the ball earlier in the pitch yields more powerful hits because the chances of hitting the ball on the "sweet spot" of the bat are improved. Further, knowing how to connect a pitched ball with the center of the bat head improves a hitter's ability to place a struck ball to a specific location, known statistically as the batters' "spray chart" tendencies (FIG. 8). In summary, batters that possess the ability to see and track a pitched ball soon after its' release from the pitcher's hand enable themselves more time to react to the spin and movement of the ball as it approaches the strike/swing zone. As reaction time improves, a batter gets closer and closer to perfecting the timing of their swing—the essential skill that separates the dominant hitters from the rest of the pack.

Baseball is the ultimate test of will and determination. As players overcome the struggle of learning such a complex sport, the stage is set for continued personal growth. As courage and self-confidence build in the physical realm, the nuances of the sport of baseball are revealed and the next stage of player development begins. The teamwork aspect of baseball is what makes the sport so rewarding. The success of the team depends on the responsibility of each individual to fully understand the official rules, the nature of responsibility for each position on offense/defense, and the coaches' philosophies and strategies for winning. This trainer play ball is intended to kick-start the rapid development of youth players in a way that is distinctly original to anyone familiar with the challenge of playing the sport of baseball.

It is well understood that marketing/promotional giveaway items are important for attracting clients and potential new business opportunities. A further embodiment of the invention may include its use as an advertising device wherein the interchangeable flight is replaced with a flag bearing a company or team name or parachute affixed to the body of the apparatus, similarly branded. In other words, the interlocking coupler means of manufacture of said invention is meant to allow for a variety of other applications that may or may not be related to sport or play. This embodiment of the invention can be accomplished in various ways such as when a flag-affixed ball is launched from an air cannon into the fan section of an arena or ballpark, or the ball is dropped from a plane or helicopter into the crowd below with parachute affixed.

Figure 1:
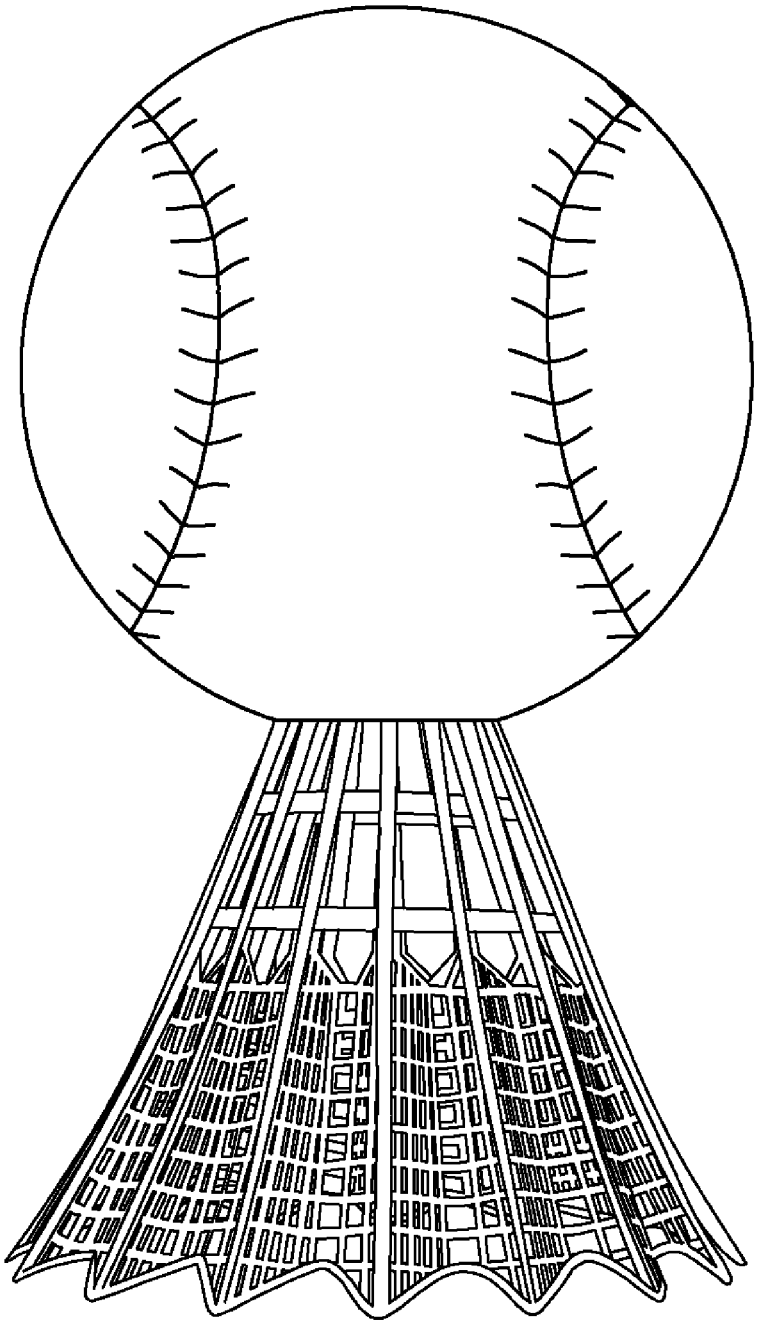
FIG. 1 shows a fully assembled play object consisting of up to three primary components of assembly wherein tail apparatus and ball are of similar size to a baseball.
Figure 2:
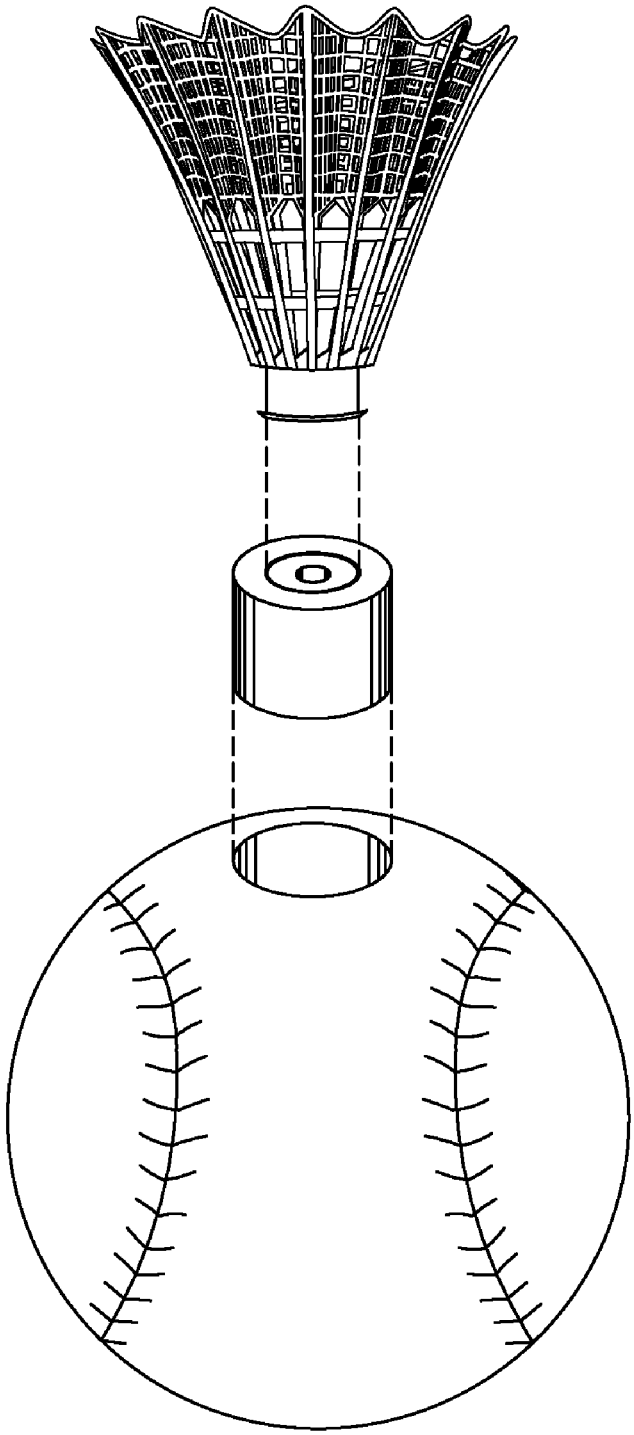
FIG. 2 shows a disassembled view of the play object consisting of three primary components of assembly being a ball, a cylindrical coupler, and a flight limiting wing or tail with a flanged tip.
Figure 3:
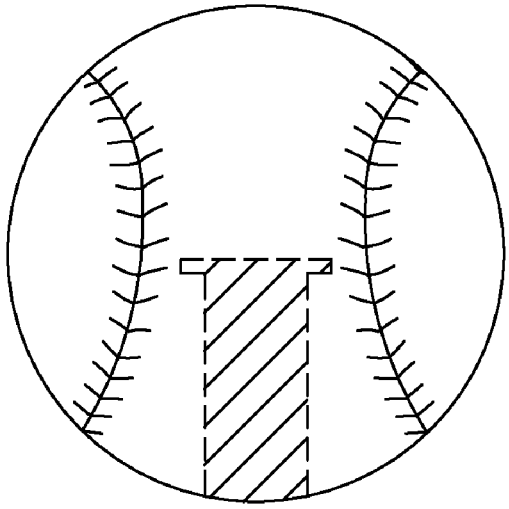
FIG. 3 shows a hidden view of cutout inside play ball for housing interlocking coupler.
Figure 4:
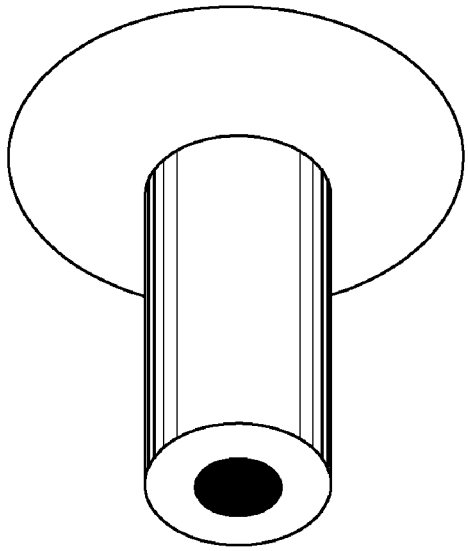
FIG. 4 shows a coupler with an extended length cylinder and flanged supporting end cap with female cavity tube.
Figure 5:
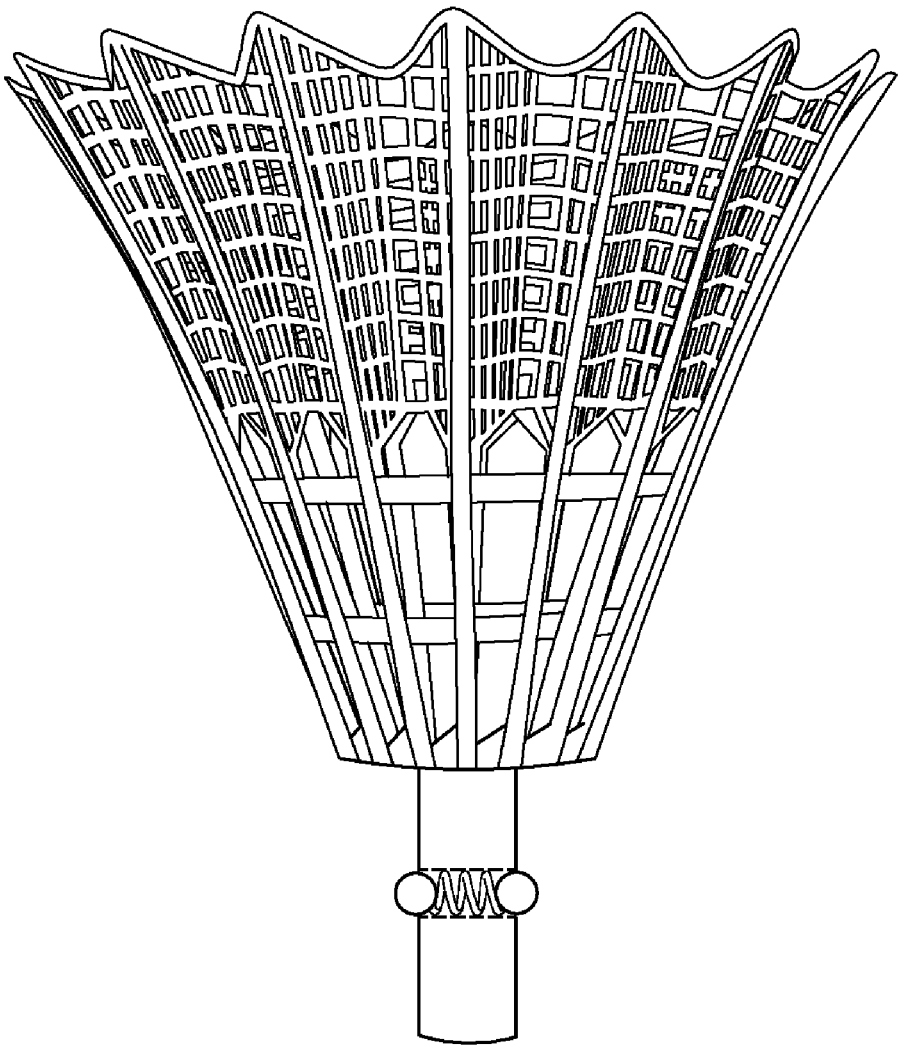
FIG. 5 shows an exploded view of male connecting end of flight apparatus housing a spring and ball bearing means of connecting a tail apparatus to ball via inset coupler.
Figure 6:
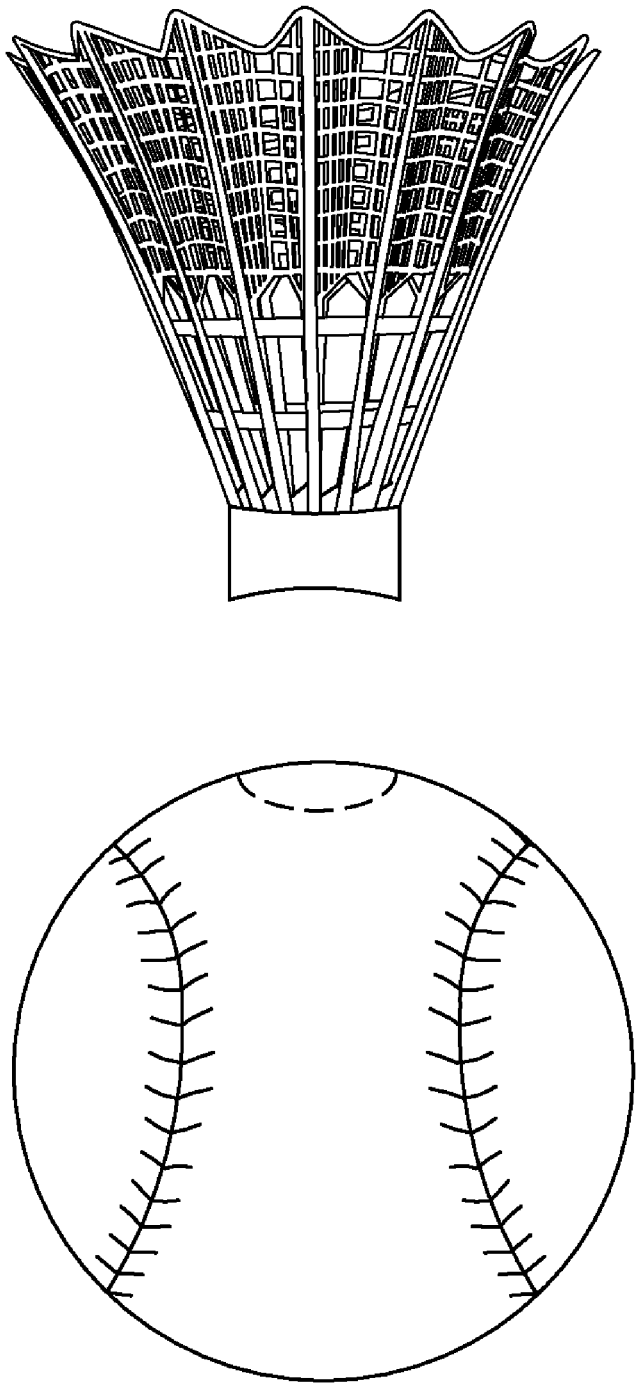
FIG. 6 shows an exploded view of conical flight affixing end with concavity anterior surface for alternative two-piece assembly.
Figure 7:
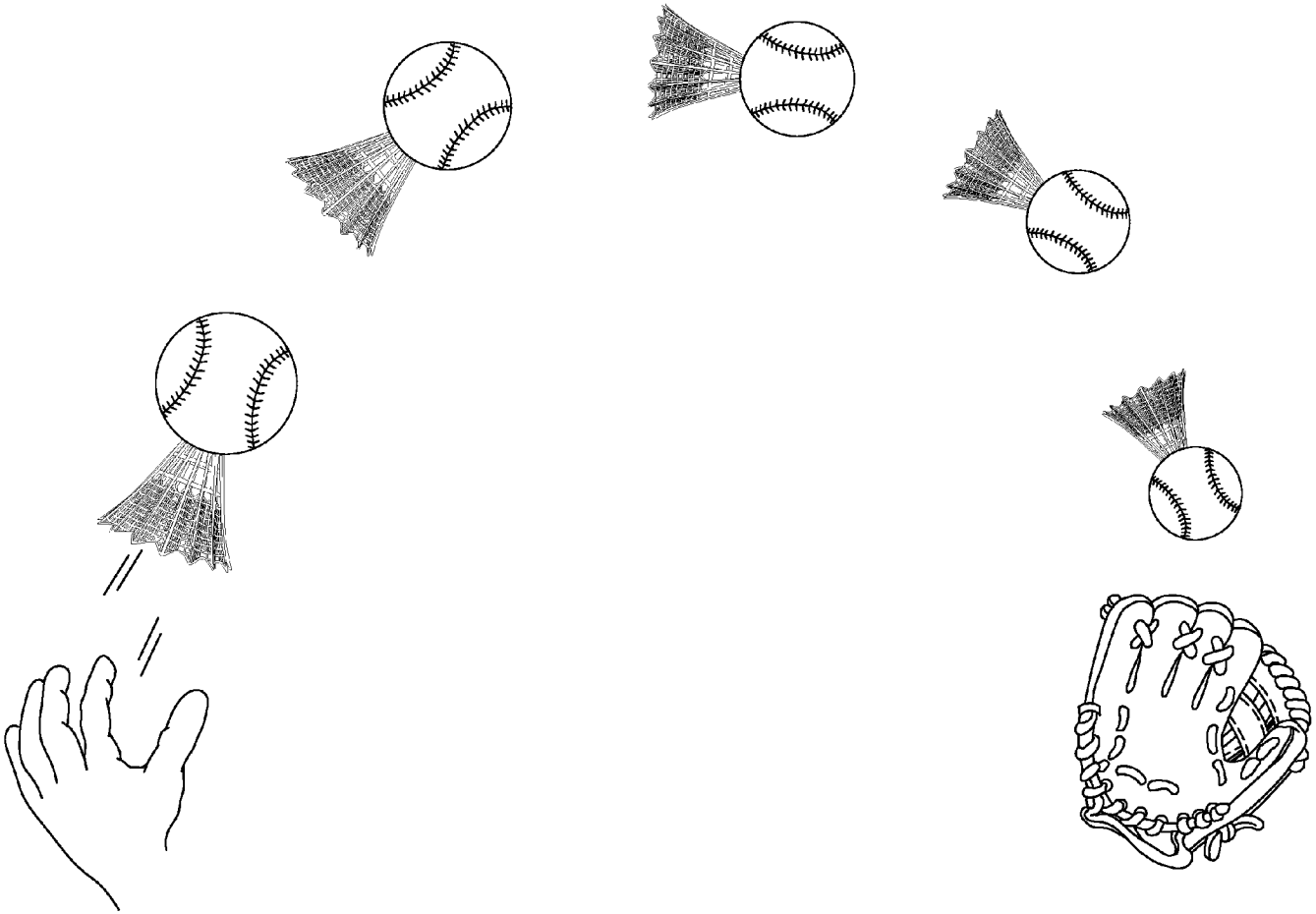
FIG. 7 shows the visual feedback of the flight path of the object play ball, helping novice players learn to track a ball in air from its' apex to the precise location where the fielder must be in order to catch the ball before hitting the ground.
Figure 8:
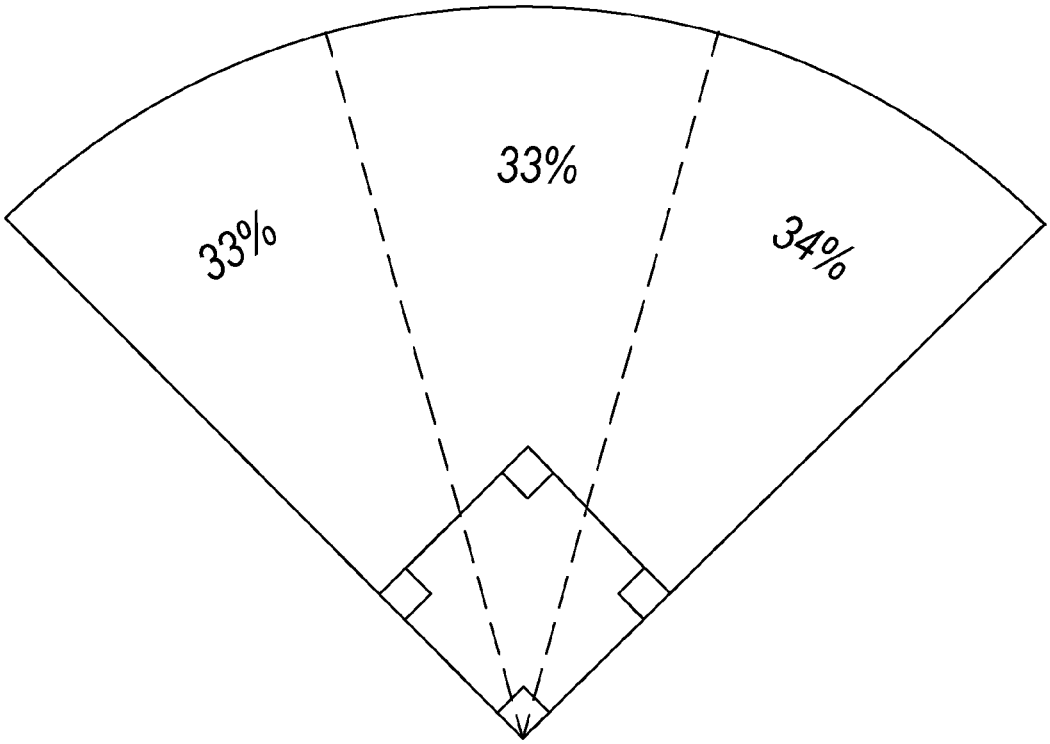
FIG. 8 shows a well-rounded batter's spray chart that demonstrates a hitter who is able to see-and-hit pitches of all types and who makes quality contact with his/her bat, regardless of where the pitch enters the strike zone.

The invention claimed is:

1. A throwing and catching apparatus, the apparatus comprising;

a generally spherical body;

a conically shaped apparatus, wherein the conically shaped apparatus includes:

a flanged tip axially oriented toward the center of the spherical body; and a locking coupler, wherein the locking coupler includes: an opposing snapping device or locking means;

wherein the conically shaped apparatus is connected to the spherical body by the locking coupler.

2. The apparatus of claim 1 wherein the generally spherical body includes a ball.

3. The apparatus of claim 1, wherein the locking coupler includes a concave coupler, wherein the concave coupler includes means for accepting at least a portion of the conically shaped apparatus.

4. The apparatus of claim 1, wherein the conically shaped apparatus includes a convex anterior.

5. The apparatus of claim 1, wherein the conically shaped apparatus is configured to control the flight of the spherical body for the purpose of batter training.

6. The apparatus of claim 1, wherein the conically shaped apparatus is configured to control the flight of the spherical body for the purpose of pitching training.

7. The apparatus of claim 1, wherein the locking coupler is inset within the spherical body.

* * * * *